US009245416B2

(12) United States Patent
Steil

(10) Patent No.: US 9,245,416 B2
(45) Date of Patent: Jan. 26, 2016

(54) SECURE IDENTIFICATION DEVICES AND METHODS FOR DETECTING AND MONITORING ACCESS THEREOF

(71) Applicant: IGT, Reno, NV (US)

(72) Inventor: Rolland N. Steil, Las Vegas, NV (US)

(73) Assignee: IGT, Las Vegas, NV (US)

( * ) Notice: Subject to any disclaimer, the term of this patent is extended or adjusted under 35 U.S.C. 154(b) by 219 days.

(21) Appl. No.: 13/937,049

(22) Filed: Jul. 8, 2013

(65) Prior Publication Data

US 2013/0296034 A1 Nov. 7, 2013

Related U.S. Application Data

(63) Continuation of application No. 11/594,658, filed on Nov. 7, 2006, now Pat. No. 8,480,484.

(60) Provisional application No. 60/735,329, filed on Nov. 9, 2005.

(51) Int. Cl.
*A63F 9/00* (2006.01)
*G07F 17/32* (2006.01)

(52) U.S. Cl.
CPC ..... *G07F 17/3248* (2013.01); *G07F 17/32* (2013.01); *G07F 17/322* (2013.01); *G07F 17/3239* (2013.01); *G07F 17/3241* (2013.01); *G07F 17/3251* (2013.01)

(58) Field of Classification Search
None
See application file for complete search history.

(56) References Cited

U.S. PATENT DOCUMENTS

| | | | |
|---|---|---|---|
| 3,766,452 | A | 10/1973 | Burpee et al. |
| 4,531,187 | A | 7/1985 | Uhland |
| 4,764,666 | A | 8/1988 | Bergeron |
| 4,814,589 | A | 3/1989 | Storch et al. |
| 5,122,643 | A | 6/1992 | Gamou et al. |
| 5,166,502 | A | 11/1992 | Rendleman et al. |
| 5,179,517 | A | 1/1993 | Sarbin et al. |
| 5,265,874 | A | 11/1993 | Dickinson et al. |

(Continued)

FOREIGN PATENT DOCUMENTS

| | | |
|---|---|---|
| EP | 0 534 187 | 3/1993 |
| EP | 1 211 630 | 6/2002 |

(Continued)

OTHER PUBLICATIONS

Bill Zender; "Card Counting for The Casino Executive"; 1990; pp. 70, 72, 74, and 76.

(Continued)

*Primary Examiner* — Seng H Lim
(74) *Attorney, Agent, or Firm* — Neal, Gerber & Eisenberg LLP

(57) ABSTRACT

A game token having a counter system including a denomination value, a housing, and a token identification element at least partially contained within the housing is disclosed. The token identification element includes an antenna configured to receive and transmit a signal, a memory configured to store a plurality of different types of token data, a counter configured to modify and maintain a read attempt value, and a processor or control logic. The processor or logic control configured to, upon a read attempt of the memory by a reader, compare a signature of the reader against the one or more authorized reader signatures, and generate an alert when the signature does not match any one of the one or more authorized reader signatures.

20 Claims, 5 Drawing Sheets

(56) References Cited

U.S. PATENT DOCUMENTS 5,287,181 A 2/1994 Holman
5,361,885 A 11/1994 Modler
5,406,264 A 4/1995 Plonsky et al.
5,471,044 A 11/1995 Hotta et al.
5,491,659 A 2/1996 Howarter et al.
5,651,548 A 7/1997 French et al.
5,655,961 A 8/1997 Acres et al.
5,693,956 A 12/1997 Shi et al.
5,702,304 A 12/1997 Acres et al.
5,722,893 A 3/1998 Hill et al.
5,735,742 A 4/1998 French
5,741,183 A 4/1998 Acres et al.
5,752,882 A 5/1998 Acres et al.
5,785,321 A 7/1998 Van Putten et al.
5,803,808 A 9/1998 Strisower
5,809,482 A 9/1998 Strisower
5,814,796 A 9/1998 Benson et al.
5,820,459 A 10/1998 Acres et al.
5,836,817 A 11/1998 Acres et al.
5,839,956 A 11/1998 Takemoto
5,880,769 A 3/1999 Nemirofsky et al.
5,890,717 A 4/1999 Rosewarne et al.
5,895,321 A 4/1999 Gassies et al.
5,919,090 A 7/1999 Mothwurf
5,920,844 A 7/1999 Hotta et al.
5,941,769 A 8/1999 Order
5,941,774 A 8/1999 Takemoto et al.
5,944,606 A 8/1999 Gerow
5,951,397 A 9/1999 Dickinson
5,957,776 A 9/1999 Hoehne
5,971,271 A 10/1999 Wynn et al.
5,988,513 A 11/1999 Dean et al.
6,013,345 A 1/2000 Koshida et al.
6,019,284 A 2/2000 Freeman et al.
6,021,949 A 2/2000 Boiron
6,039,650 A 3/2000 Hill
6,135,884 A 10/2000 Hedrick et al.
6,152,620 A 11/2000 Ozawa et al.
6,165,069 A 12/2000 Sines et al.
6,174,836 B1 1/2001 Hotta et al.
6,186,895 B1 2/2001 Oliver
6,251,014 B1 6/2001 Stockdale et al.
6,264,109 B1 7/2001 Chapet et al.
6,267,671 B1 7/2001 Hogan
6,296,190 B1 10/2001 Rendleman
6,299,536 B1 10/2001 Hill
6,313,856 B1 11/2001 Ulrich
6,327,376 B1 12/2001 Harkin
6,394,907 B1 5/2002 Rowe
6,422,468 B1 7/2002 Nishizawa et al.
6,431,453 B1 8/2002 Hill et al.
6,431,983 B2 8/2002 Acres
6,450,407 B1 9/2002 Freeman et al.
6,460,848 B1 10/2002 Soltys et al.
6,464,584 B2 10/2002 Oliver
6,503,147 B1 1/2003 Stockdale et al.
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,561,897 B1 5/2003 Bourbour et al.
6,579,181 B2 6/2003 Soltys et al.
6,581,747 B1 6/2003 Charlier et al.
6,582,301 B2 6/2003 Hill
6,595,857 B2 7/2003 Soltys et al.
6,609,710 B1 8/2003 Order
6,612,928 B1 9/2003 Bradford et al.
6,619,662 B2 9/2003 Miller
6,626,757 B2 9/2003 Oliveras
6,629,019 B2 9/2003 Legge et al.
6,629,591 B1 10/2003 Griswold et al.
6,629,889 B2 10/2003 Mothwurf
6,638,161 B2 10/2003 Soltys et al.
6,652,379 B2 11/2003 Soltys et al.
6,659,875 B2 12/2003 Purton
6,663,490 B2 12/2003 Soltys et al.
6,671,358 B1 12/2003 Seidman et al.
6,675,152 B1 1/2004 Prasad et al.
6,682,421 B1 1/2004 Rowe et al.
6,685,564 B2 2/2004 Oliver
6,685,568 B2 2/2004 Soltys et al.
6,688,979 B2 2/2004 Soltys et al.
6,690,673 B1 2/2004 Jarvis
6,709,333 B1 3/2004 Bradford et al.
6,712,696 B2 3/2004 Soltys et al.
6,712,698 B2 3/2004 Paulsen et al.
6,733,388 B2 5/2004 Mothwurf
6,745,944 B2 6/2004 Dell
6,747,560 B2 6/2004 Stevens, III
6,758,751 B2 7/2004 Soltys et al.
6,769,986 B2 8/2004 Vancura
6,800,030 B2 10/2004 Acres
6,825,833 B2 11/2004 Mulligan et al.
6,831,710 B2 12/2004 den Boer
6,834,251 B1 12/2004 Fletcher
6,843,725 B2 1/2005 Nelson
6,848,994 B1 2/2005 Knust et al.
6,852,031 B1 2/2005 Rowe
6,905,411 B2 6/2005 Nguyen et al.
RE38,812 E 10/2005 Acres et al.
6,967,563 B2 11/2005 Bormaster
7,018,291 B1 3/2006 Lemke et al.
7,027,056 B2 4/2006 Koselj et al.
7,088,326 B2 8/2006 Lin et al.
7,112,138 B2 9/2006 Hedrick
7,119,759 B2 10/2006 Zehner et al.
7,128,482 B2 10/2006 Meyerhofer et al.
7,152,045 B2 12/2006 Hoffman
7,172,507 B2 2/2007 Fujimoto et al.
7,192,208 B2 3/2007 Meyerhofer
7,240,023 B1 7/2007 Powell
7,267,614 B1 9/2007 Jorasch et al.
7,287,695 B2 10/2007 Wankmueller
7,329,186 B2 2/2008 Griswold et al.
7,455,591 B2 11/2008 Nguyen
7,611,411 B2 11/2009 Griswold
7,918,455 B2 4/2011 Chapet et al.
7,946,917 B2 5/2011 Kaminkow et al.
7,982,617 B2 7/2011 Koyama et al.
7,988,551 B2 8/2011 Walker et al.
7,993,198 B2 8/2011 Walker et al.
2002/0147042 A1 10/2002 Vuong et al.
2002/0167500 A1 11/2002 Gelbman
2002/0173354 A1 11/2002 Winans et al.
2003/0036425 A1* 2/2003 Kaminkow et al. ..... 463/25
2003/0064798 A1 4/2003 Grauzer et al.
2003/0064812 A1 4/2003 Rappaport et al.
2003/0078094 A1 4/2003 Gatto et al.
2003/0162591 A1 8/2003 Nguyen et al.
2003/0162593 A1 8/2003 Griswold
2003/0167207 A1* 9/2003 Berardi et al. ..... 705/16
2003/0171145 A1 9/2003 Rowe
2003/0195093 A1 10/2003 White et al.
2003/0199312 A1 10/2003 Walker et al.
2004/0043813 A1 3/2004 Chamberlain et al.
2004/0087375 A1 5/2004 Gelinotte
2004/0136764 A1 7/2004 Meyerhofer et al.
2004/0192438 A1 9/2004 Wells et al.
2004/0192442 A1 9/2004 Wells et al.
2004/0204233 A1 10/2004 Saffari et al.
2004/0209674 A1 10/2004 Conover et al.
2004/0233930 A1 11/2004 Colby, Jr.
2005/0077995 A1 4/2005 Paulsen et al.
2005/0082750 A1 4/2005 Grauzer et al.
2005/0085293 A1 4/2005 Lindo
2005/0090308 A1 4/2005 Weiss
2005/0159913 A1* 7/2005 Ariyoshi et al. ..... 702/122
2005/0171898 A1* 8/2005 Bishop et al. ..... 705/39
2005/0178822 A1* 8/2005 Siuta et al. ..... 235/379

(56) References Cited

U.S. PATENT DOCUMENTS

| | | | | |
|---|---|---|---|---|
| 2005/0225080 | A1 | 10/2005 | Wicker | |
| 2005/0240778 | A1 | 10/2005 | Saito | |
| 2005/0282626 | A1 | 12/2005 | Manfredi et al. | |
| 2006/0000891 | A1 | 1/2006 | Bonalle et al. | |
| 2006/0000892 | A1 | 1/2006 | Bonalle et al. | |
| 2006/0000893 | A1 | 1/2006 | Bonalle et al. | |
| 2006/0000894 | A1 | 1/2006 | Bonalle et al. | |
| 2006/0000895 | A1 | 1/2006 | Bonalle et al. | |
| 2006/0012473 | A1* | 1/2006 | Bishop et al. | 340/539.1 |
| 2006/0016884 | A1 | 1/2006 | Block et al. | |
| 2006/0019745 | A1 | 1/2006 | Benbrahim | |
| 2006/0025212 | A1 | 2/2006 | Griswold et al. | |
| 2006/0177109 | A1 | 8/2006 | Storch | |
| 2006/0205508 | A1 | 9/2006 | Green | |
| 2006/0267733 | A1* | 11/2006 | Steinke et al. | 340/10.1 |
| 2006/0281537 | A1 | 12/2006 | Abbott et al. | |
| 2007/0021191 | A1 | 1/2007 | White et al. | |
| 2007/0026204 | A1 | 2/2007 | Caulley et al. | |
| 2007/0029394 | A1 | 2/2007 | Wicker et al. | |
| 2007/0032295 | A1 | 2/2007 | Muir et al. | |
| 2007/0035399 | A1 | 2/2007 | Hecht et al. | |
| 2007/0057469 | A1 | 3/2007 | Grauzer et al. | |
| 2007/0060311 | A1 | 3/2007 | Rowe et al. | |
| 2007/0094721 | A1 | 4/2007 | Nguyen et al. | |
| 2007/0173318 | A1* | 7/2007 | Abbott | 463/25 |
| 2007/0293303 | A1 | 12/2007 | Shayesteh | |
| 2009/0011821 | A1 | 1/2009 | Griswold et al. | |
| 2010/0093428 | A1 | 4/2010 | Mattice et al. | |
| 2010/0093429 | A1 | 4/2010 | Mattice et al. | |
| 2010/0197383 | A1 | 8/2010 | Rader et al. | |

FOREIGN PATENT DOCUMENTS

| | | |
|---|---|---|
| EP | 1 310 925 | 5/2003 |
| WO | WO99/25439 | 5/1999 |
| WO | WO00/22585 | 4/2000 |
| WO | WO03/058878 | 7/2003 |
| WO | WO2004/013820 | 2/2004 |
| WO | WO2004/034321 | 4/2004 |
| WO | WO2006/037220 | 4/2006 |
| WO | WO2006/039180 | 4/2006 |
| WO | WO2009/026180 | 2/2009 |
| WO | WO2009/026295 | 2/2009 |

OTHER PUBLICATIONS

Digi Deal Corporation; Digital 21; "The Classic Game"; 2005; 1 page.

Don Schlesinger; "Blackjack Attack Playing The Pros' Way"; 3rd Edition—The Ultimate Weapon, 2004; pp. 16, 492, and 493.

Edward O. Thorp; "Beat The Dealer"; 1966; pp. 116 and 117.

International Gaming & Wagering Business; "Table Game Trends"; 2004; 22 pages.

Mikohn Gaming Corporation; "Tablelink Total View The New Standard in Table Games"; 2005; 11 pages.

"TableLink™ The New Standard in Table Games"; Mikohn; brochure; 18 pages; 1999.

TCS John Huxlexy; "Protec 21 Blackjack Security"; 2005; 2 pages.

* cited by examiner

SECURE IDENTIFICATION DEVICES AND METHODS FOR DETECTING AND MONITORING ACCESS THEREOF

PRIORITY CLAIM

This application is a continuation of and claims priority to U.S. patent application Ser. No. 11/594,658 entitled SECURE IDENTIFICATION DEVICES AND METHODS FOR DETECTING AND MONITORING ACCESS THEREOF, which was filed on Nov. 7, 2006, which claims priority to Provisional Patent Application No. 60/735,329 entitled Secure Identification Devices and Methods for detecting and Monitoring Access Thereof, which was filed on Nov. 9, 2005. U.S. patent application Ser. No. 11/594,658 is incorporated by reference in its entirety.

FIELD OF THE INVENTION

The invention relates to identification devices and more particularly to radio frequency identification devices and methods for detecting and monitoring access of an identification device.

RELATED ART

RFID (Radio Frequency Identification) type tags have become a popular way to monitor and track items. RFID tags have found use in stores, to track merchandise, and warehouses, to track product. Casinos often utilize RFID technology within tokens to monitor game play. RFID technology provides for rapid access, without a wired connection, to data on the RFID tag.

Although RFID technology has numerous uses, one such example environment is in connection with gambling. Gambling has become a popular form of entertainment in the United States and in numerous foreign countries. Numerous wagering events are offered within the casino or other gaming environment, one of the most traditional and popular forms of wagering occurs at table games. As is widely understood, traditional table games utilize a playing surface, often called a felt, upon which a dealer or other game operator offers a wagering event to one or more players or upon which a player may make a bet or wager.

As compared to slot or video type games, traditional table games offer greater excitement for some players, group play, and often attract big money players, which can result in larger profit margins for the casino. Prior art systems make use of gaming tokens embedded with Radio Frequency Identification ("RFID") to track a player's betting for this purpose. An example of such a system is the Mikohn® Gaming Corporation's d/b/a Progressive Gaming International Corporation's Tablelink® product.

However, even with prior art bet tracking techniques, numerous opportunities for player manipulation of token RFID information may be missed or unmonitored. To prevent such cheating, a myriad of human game protection elements may be employed in a casino to monitor table games. The monitors comprise of pit bosses, dealers, video surveillance personal, security guards, and the like. However, these individuals cannot monitor every bet, and are an expensive option for a casino.

Current tokens including RFID information have limited capability and hence may be at risk of being compromised. These security limitations have inhibited progress in the expansion of RFID capability and the amount or type of information embedded therein.

The method and apparatus described below overcomes these drawbacks and provides additional benefits.

SUMMARY

In one embodiment of the invention, a DID gaming token comprises, in combination a communication device configured to receive power and data from at least one reader and a power converter device configured to provide power to a processor including read-write logic and counter logic of the DID gaming token. The processor is configured to receive data from the communication device and communicate with a memory of the DID gaming device. The counter logic of the DID token is configured to selectively increment a portion of the memory to indicate when the DID gaming token has been accessed by at least one reader. The memory is to configured to be written to by the read-write logic within the DID, and the memory is configured to be read-only when accessed by an external system.

In another embodiment of the invention, a method for detecting and monitoring access of a DID is disclosed. The method comprises the step of providing a DID including a communication device configured to receive transmission from at least one reader, a power converter device, memory, and a processor including read-write logic and counter logic. The method further comprises the steps of powering the power converting device with at least one reader and accessing the DID with at least one reader. The method further comprises the step of selectively incrementing a portion of memory with the counter logic to indicate when the DID has been accessed by at least one reader.

In one variation, the invention comprises a system for tracking access of a game token. The game token has a token identification element comprising one or more token memories configured to store at least one type of token data and at least one counter value. The game token also has a counter configured to modify the counter value each time the token data is read. The system further comprises one or more authorized readers that are configured to read the token data from the token during play of a wagering game and communicate the token data to a computer to enable the computer to track use of the game token during play of a game.

In another embodiment, the system may further comprise a processor in communication with one or more authorized readers, and memory associated with the processor, such that the memory stores processor executable machine readable code configured to maintain and modify a reader access value. The reader access value represents the number of times the game token has been read by an authorized reader. The system may have one or more authorized readers or a counter value reader that is configured to read the counter value from the game token. Additionally, the system may have processor executable machine readable code that is configured to compare the counter value stored on the game token to the reader access value.

In another variation, the processor executable machine readable code is configured to generate an alert in response to the comparison of the counter value stored on the game token to the reader access value. Additionally, the system may have a token identification element that further comprises a token identification element processor configured to execute machine executable code. The machine executable code performs the modification to the counter value and the modification may comprise an incremental value.

It is further contemplated that the invention may comprise a game token having a counter system. The game token comprises a housing and a token identification element at least partially contained within the housing. The token identification element may include one or more antenna configured to receive and transmit a signal, a processor or control logic configured to perform memory read operations and to generate a control signal in response to a memory read operation. Also part of the identification element is a memory configured to store token data and a read attempt value, and a counter, which is configured to be responsive to the control signal. The counter may be configured to modify a read attempt value to maintain the read attempt value within the token such that the read attempt value represents the number of read attempts of the memory. The game token may further comprise token data representing one or more of the following: token value, token serial number, read attempt value.

In another variation, the memory is further configured to store a successful read value representing a number of successful reads of the memory. In addition, modifying a read attempt value may further comprise retrieving the read attempt value from memory, incrementing the read attempt value with the counter to create an incremented read attempt value, and writing the incremented read attempt value to the memory. The read attempt value may represent the actual number of times token data was read from memory. The game token may also contain token data that comprises any type data stored in the token.

It is further contemplated that the game token may additionally include a reader system comprising one or more authorized readers configured to energize the token identification element. Also part of the reader system is memory configured to store machine readable code and one or more processors configured to execute the machine readable code. The machine readable code may be configured to maintain a token read value external to the game token representing the number of times the token identification element was read.

Also disclosed herein is a method for tracking read attempts of a readable memory in a game token. The method comprises generating a read signal to energize a token identification element in an attempt to read data from the readable memory. The method further comprises energizing the token identification element to attempt reading data from the readable memory. In response to attempting to read data from the readable memory, the method may modify a token counter value. The token counter value may represent the number of times an attempt has been made to read data from the readable memory.

It is further contemplated that the token counter value may be stored in a memory within the token or conversely the token counter value may be stored in a memory external to the token. The method may further comprise maintaining a read attempt value for a particular game token by which the read attempt value represents the number of times an authorized reader has attempted to read data from a token. Additionally, the method may also include comparing the read attempt value to the token counter value and in response to the comparison, optionally generating an alert. The read attempt value may also be stored within a server in communication with an authorized reader. In another variation, the method further comprises modifying a second counter value when a read attempt is unsuccessful.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

Various radio frequency identification devices (hereinafter denoted RFID) and systems that are well known for use in the gaming industry. Without limiting the disclosure herein, it is understood that the various aspects of RFID technology and RFID systems as illustrated below may be applied to other types of RFID elements and RFID systems and environments other than gaming.

Figure 1:
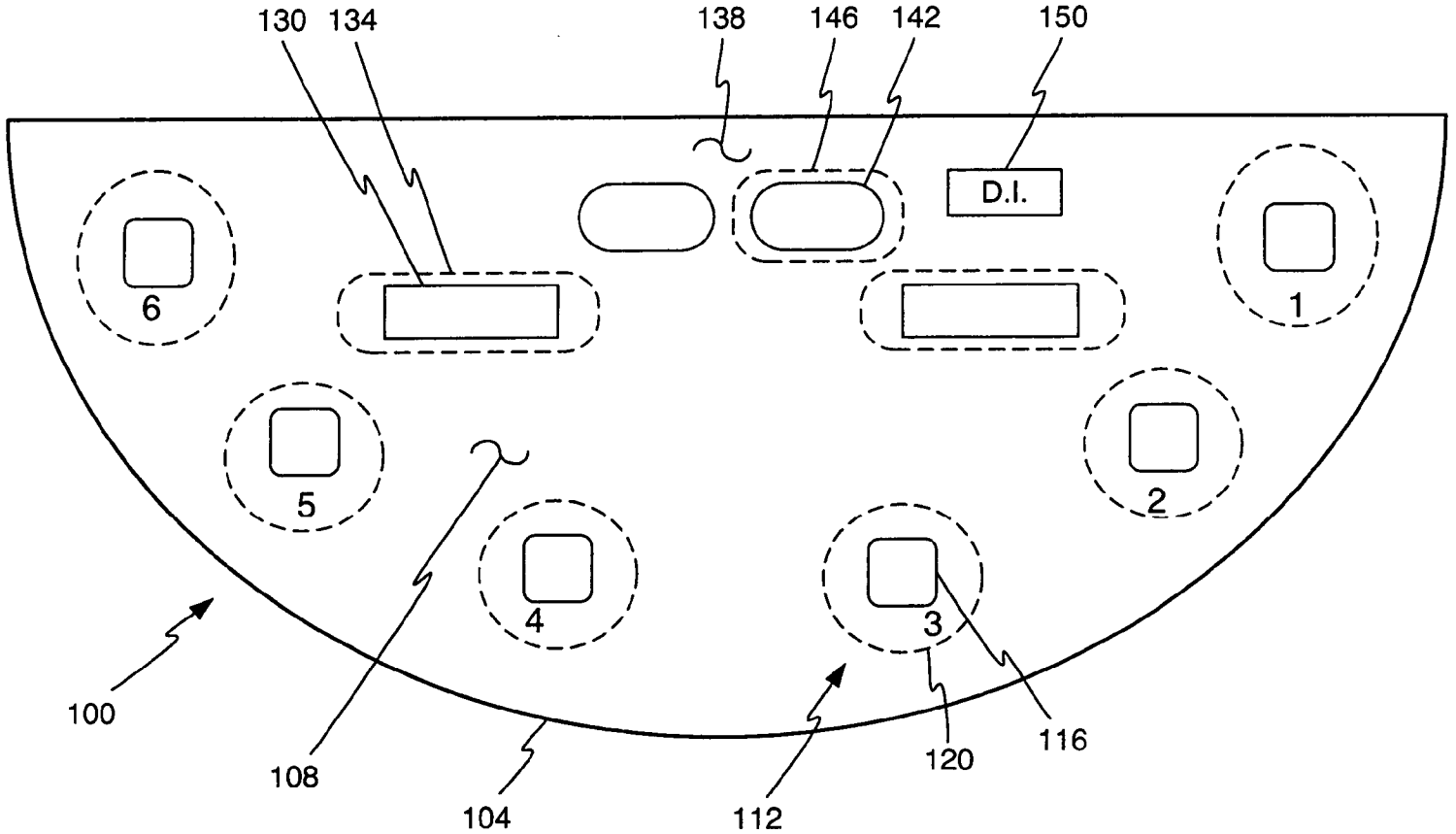
FIG. 1 illustrates a top plan view of an example embodiment of a table for use with a table game.

FIG. 1 illustrates a top plan view of an example embodiment of a gaming table for use with a table game. This is but one possible table arrangement and layout and it is contemplated that one of ordinary skill in the art may arrive at other table arrangements to promote game play or accommodate a greater or fewer number of players. For example, it is contemplated that the method and apparatus described herein may be utilized with any game layout. Likewise, the table can be configured in a stand-up or sit down arrangement. In this example embodiment the table 100 includes an outer edge 104 surrounding a generally flat top surface 108. The table may also be configured to accommodate other types of traditional table games including, but not limited to, dice games such as a modified form of craps, poker, baccarat, or non-proprietary table games such as roulette, and other games which use dice, wheels, or cards or any combination of dice, wheels, or cards. Table games include games of chance that use cards or dice, and tokens (also denoted as gaming chips) of differing values. Traditional table games also include proprietary games such as Caribbean Stud Poker® which include a progressive jackpot. Other proprietary traditional table games include games such as Three Card Poker®, Royal Match 21® and Texas Hold'em Bonus™. Proprietary table games are table games for which a casino will lease or purchase from a manufacturer because the proprietary traditional table game is protected by the intellectual property of the manufacturer. The term "traditional table game" is used to distinguish from products offered by TableMAX® and Digideal's Digital 21 which use video representations of cards. There are other non-traditional table games that have digital roulette wheels with video or digital images of dealers.

In this example embodiment of a table 100, configured for use with the game of black jack, there is an outer edge 104 of the table. One or more player stations 112 (also denoted herein as player locations) are provided and configured for use by a player to participate in a waging game or a game of chance offered at the table such as blackjack. In this embodiment the player stations 112 comprise a bet spot 116 wherein a player may place one or more wagers during the course of play. For example, the player may place the gaming chips or tokens within the area of bet spot 116 when placing a bet during the course of play. Overlapping the bet spot 116 is a detection zone 120. The detection zone 120 comprises a zone within which a bet detection system (see description below) may detect the token, such as an amount bet by a player at the player station 112 at the table 100. Likewise, other data stored on the token may also be detected by the bet detection system.

In other various embodiments, one or more supplemental bet spots may be located in one or more other locations on the table surface 108. By way of example, a supplemental bet spot 130 may be located as shown in FIG. 1 and shared by more than one player. A supplemental detection zone 134 may likewise be associated with the supplemental bet spot 130 to detect a bet therein. The supplemental bet spots may also comprise token buy-in spots that have detection capability to detect player's buy-in. A supplemental detection zone may also be added to detect multiple bets that are required or optional by a player in proprietary table games such as Caribbean Stud Poker®, Three Card Poker®, Royal Match 21®, Texas Hold'em Bonus™, and Two Card Joker Poker™.

In this example embodiment a dealer position 138 is located generally opposite one or more of the player positions. As is generally understood, the dealer presents the game from the dealer station 138. Associated with the dealer station 138 are one or more dealer spots 142 which in turn may be associated with one or more dealer detection zones. The dealer spot 142 is a location on or in some way associated with the table 100 and/or the dealer on which tokens may be placed for detection by the detection system. As used herein, the term token may refer to a DID (detectable identification device) type token. The dealer detection zone 146 is the area in which the detection system can detect tokens placed in the dealer spot 142. This dealer detection zone 146 could be used in player banked traditional table games such as those played in the State of California or other jurisdictions. The dealer detection zone 146 may also be used to hold ante bets contributed by players in Class II gaming jurisdictions such as Native American gaming establishments in the State of Florida.

A dealer interface 150 (referred to as D.I in FIGS. 1 and 2) may also be placed near the dealer position 138. The dealer interface 150 comprises a user interface configured to allow the dealer to provide input to the detection system and optionally receive input from the detection system. In various embodiments, the dealer interface 150 comprises one or more buttons, dials, display screens, lights or other illumination devices, speakers or other audible indicators, or analog dials, potentiometers, or keypads. Through use of the dealer interface 150, the dealer is able to provide input to the detection system or receive data from the detection system.

Figure 2:
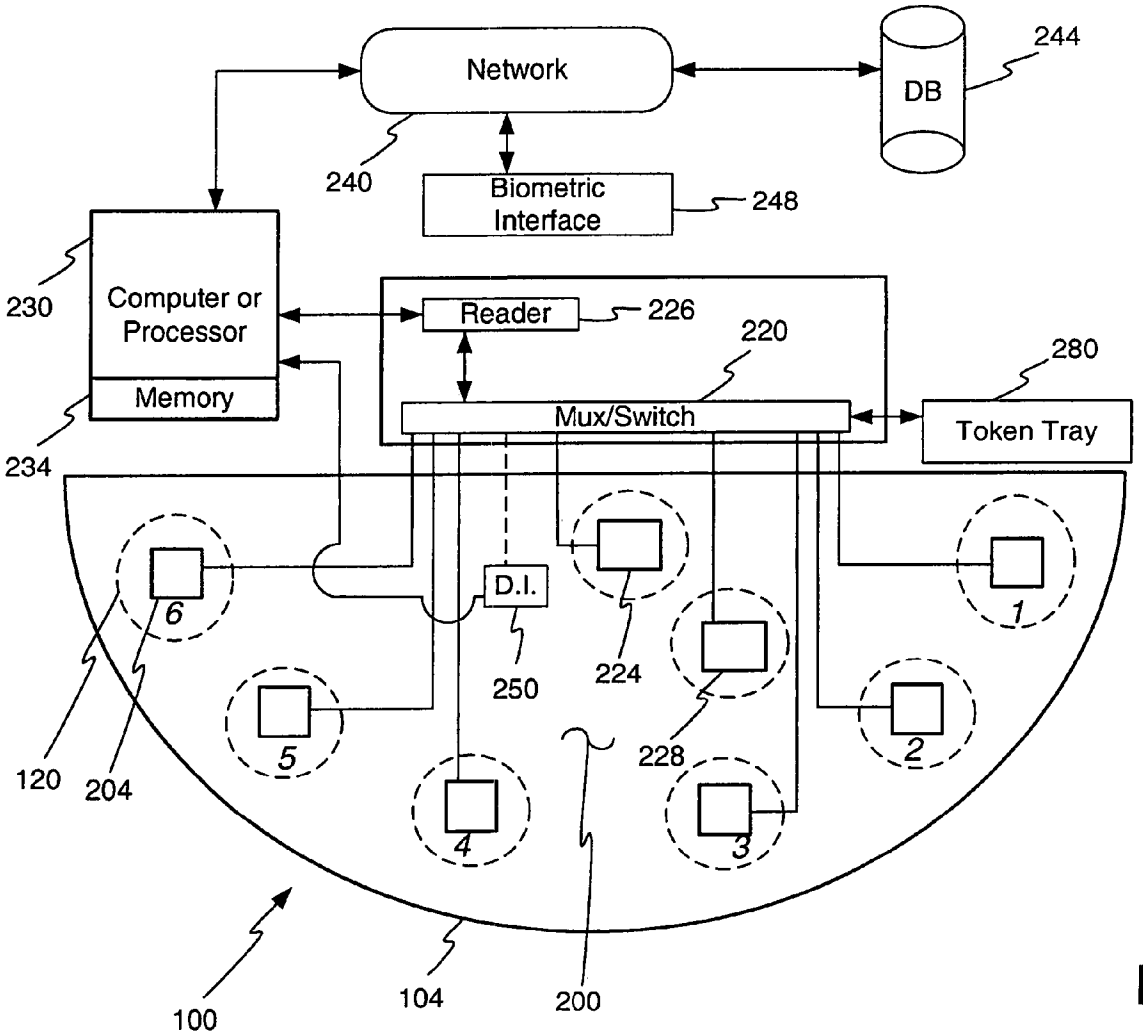
FIG. 2 illustrates a block diagram of a detection system in connection with a game table.

FIG. 2 illustrates a block diagram of the detection system in connection with a game table. This is but one possible example configuration and the elements of the detection system as shown are for purposes of discussion and hence are not to scale.

As part of the table 100, there is an underside 200 of the table, which is shown in FIG. 2. By way of reference, the outer surface 104 and player positions labeled 1-6 are shown. A player DID antenna 204 may be mounted below the table 100, and may be integral with the table, or on the top of the table. In this embodiment of the detection system, the player DID antenna 204 is below or on the underside 200 of the table and provides a detection zone 120 when so instructed by the detection system described above. The detection zone 120 may also be understood as an area in which the energy emitted by the antenna energizes the DID detectable identification of the token.

The player DID antenna 204 connects to a multiplexer, diplexer, or switch 220, which in this embodiment controls communication between a reader 226 and the player DID antenna. It is contemplated that communication between the reader 226 and the one or more player DID antenna 204 is bi-directional such that the reader may provide an electrical excitation signal to the player DID antenna. The player DID antenna 204 converts the electrical signal to an electro-magnetic field (EMF), which excites or powers the DID aspects of the token located within the detection zone. As a result and in response to the excitation EMF signal, the player DID antenna 204 may also detect data emitted from the DID. The data is sent back, via the multiplexer 220, to the reader 226.

A token tray 280 may also be provided that reads and/or writes to any token within the tray and may report newly incoming tokens and outgoing tokens. This provides the monitoring system with data regarding the tokens purchased by or paid out to players and tokens collected from players. This allows the system to further track incoming and outgoing tokens. Tokens purchased by a player and not passing through the token tray 280, i.e. won or cashed in, may be assumed to have left with or been kept by the player. Tokens presented for play on the table 100 that do not pass through the token tray 280 may be assumed to have been brought to the table by the player.

In one embodiment, the electronic readable token tray 280 can provide token inventory information within any four wall casino or multi site casinos and managed by any software that is separate or part of the full player tracking system that in turn will provide, at a moments notice, the entire banked token inventory, each token tray inventory, floating token inventory (tokens not in play and not in the bank), and notification when a de-issued token has been received or played.

Operation of each player DID 204 antenna associated with each of the player stations 112 occurs as described above. A dealer DID antenna 224 is also provided with an associated detection zone. One or more secondary bet or token spot antenna 228 with associated detection zone is also provided as shown. These elements 224, 228 also connect to the multiplexer/switch 220. A reader 226 may selectively read the DID information contained within the tokens placed at the bet spots 116 as shown in FIG. 1 during the course of game play. A device other than a multiplexer may be used to concurrently energize more than one antenna to speed the read process. A dealer interface 250 also connects to a monitoring system, such as to a computer 230, or via the multiplexer 220 to thereby provide input to the computer 230, such as shuffle and new game data, place bets data, no bets accepted data or any other indication signals. The detection system on the computer 230 may also detect if bets are made or changed at times that are not allowed.

The reader 226 connects to any type processor which may be embodied in a computer 230 having memory 234. The computer is configured to execute machine readable code which may be stored on the memory 234. The machine readable code may comprise software code or code logic capable of interaction with other systems, such as the reader 226. The computer 230 may include an input interface for receiving input from a user such as pit supervisory personnel or dealer, such as a keyboard, analog dial, potentiometer, mouse, touch screen, or any other device capable of providing information to the computer. The computer 230 may also be configured with one or more displays. The computer 230 will allow the input of information by pit supervisory personnel and/or a dealer.

In the embodiment shown in FIG. 2, the computer 230 connects to a network 240 which in turn may connect to a database 244 and/or a biometric interface 248. A database 244 is generally understood in the art as an accessible memory for storing accessible data. The network 240 may include access by surveillance personnel in the casino.

The biometric interface 248 comprises any type system configured to monitor and identify players based on one or more player characteristics. In one such configuration a camera is capable of capturing a player's picture, such as of their face, and the biometric system compares the player's picture to a data base of known dishonest players or banned individuals. The biometric system 248 in connection with the bet detection system may be utilized to monitor for and identify certain players who may be attempting to gain an unfair advantage. One exemplary biometric system is available from Biometrica Systems, Inc in Las Vegas, Nev.

It is also contemplated that the computer 230 and the network 240 may be equipped to send and receive e-mail or other forms of electronic output. In one embodiment, the detection system, such as the computer 230, the network 240, or a mail server associated with the network, may be controlled to send e-mail, voice messages, or other notification to a party to alert or notify them of information generated by the detection system.

It is further contemplated that the system shown in FIG. 2, or any system configured to interact with DID elements may maintain a record of each time a reader performs a particular action or request to the DID element. This data may be stored in the computer 230 or network 240. This action is associated with the element regardless of which authorized reader initiates the action within the DID element. In this manner, a running total is maintained by the system 226, 230, 240 of the number of times a particular action has occurred within the DID element as a result of the initiation of such action by an authorized reader. For example, when the identification of the DID element is read by an authorized reader, the reader system 226, 230, 240 increments a value that represent the number of times the identification of that particular DID element is read. Hence a running total of the number of times a particular DID element executes a particular operation is kept by the reader system. As discussed below, this may be cross referenced against or compared to a concurrently maintained counter value within the DID element.

In operation, the system shown in FIG. 2 operates to monitor tokens on the table. Numerous different aspects or methods of monitoring the tokens on the table are possible.

When the tokens are monitored or detected, in the various manners described below, the token information may be provided to the computer, processed in the manner described below, and output to a dealer, pit supervisory personnel, surveillance, casino hosts, or other third party. In one embodiment the processing may occur at the table itself such as with a controller or control logic, and not at the computer.

The detection system may be configured in any desired manner, such as described below. In general, the detection system detects tokens on the table. The detection system may be configured to detect player cheating such as when a player alters a token's denominational face value. In other embodiments, as discussed herein, the detection system may be utilized for other monitoring and reporting functions.

Figure 3:
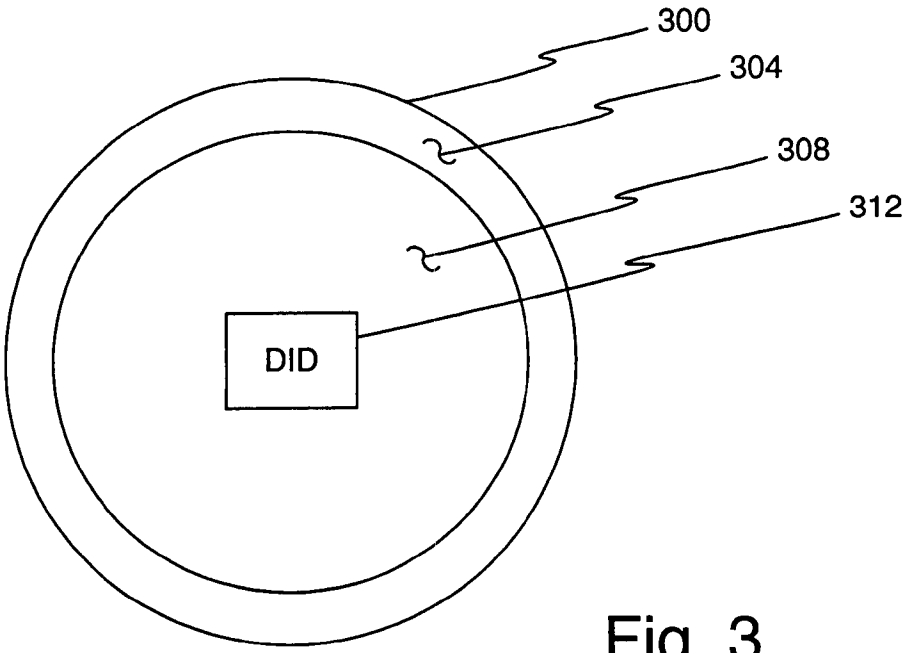
FIG. 3 illustrates a top plan view of a token comprising a detectable identification device (DID).

FIG. 3 illustrates a top plan view of a token equipped with a detectable identification device (hereinafter DID). The term DID is defined to mean any technology that may be associated with the token or in any way imbedded within the token to allow for detection of the token using sensing technology. One example of DID technology is radio frequency identification (RFID) technology wherein a sensor is imbedded within a token and the sensor may be activated or powered using an antenna and/or energy emitting device thereby causing the DID to emit data. RFID tokens are available from Gaming Partners International, located in Las Vegas, Nev.

As shown in FIG. 3, a token 300 comprises an outer surface and edge often formed in a coin shape. An outer rim 304 may be provided with markings and to provide support to the structure of the token 300. Inside the area defined by the outer ring 304 is a middle area 308 of the token 300. The middle area, or other area of the token, includes a DID element 312 (alternatively denoted a tag 312) that may be configured to identify any type of information associated with the token. The information stored or associated with the token may comprise the value assigned to the token; an identification code or serial number (which is typically unique); player information, if so assigned, a client or casino name, secret data, encryption information or codes, public information, physical chip size, data regarding memory, creation or in use date, DID type or family, denominational value of the token, locality code to provide for currency differences in different localities, and the like.

In one example embodiment the token 300 having DID element 312 comprises a microchip having read and write memory, such as for example 256 bits and the like, with one or more configurable sections of the microchip to meet a particular application. Data may be entered into the DID element 312 and sealed or encrypted to prevent fraud or tampering. In one embodiment, at least some of the data stored within the DID element 312 may be changed or updated by a casino or when provided to a player.

While the above description refers to a DID element of a token, it is understood that a DID element may also be embedded directly in any DID including, but not limited to a card, key chain, jewelry item, watch, such as on the back of a watch, into a wallet, as part of a bracelet, into or part of a purse, into a player tracking card (with or without a magnetic strip), money clip, room key, under the skin, on or part of glasses, back of a credit card, drivers license, smartcards, or other item or card type element. The term DID element is defined to mean any portion of a DID that is capable of being detected by a detection system, such as the detection system described herein. Any type technology may be used to detect the DID element. In operation, the DID element, regardless of how it is housed or contained may be interrogated by the detection system described herein.

Although described in FIG. 3 in the nature of a gaming token, it is contemplated that tags or RFID elements as described herein may be utilized in any environment or in other configurations than a gaming token. The method and apparatus described herein may be utilized in any environment where monitoring usage or attempted usage of the DID element is desired.

Figure 4:
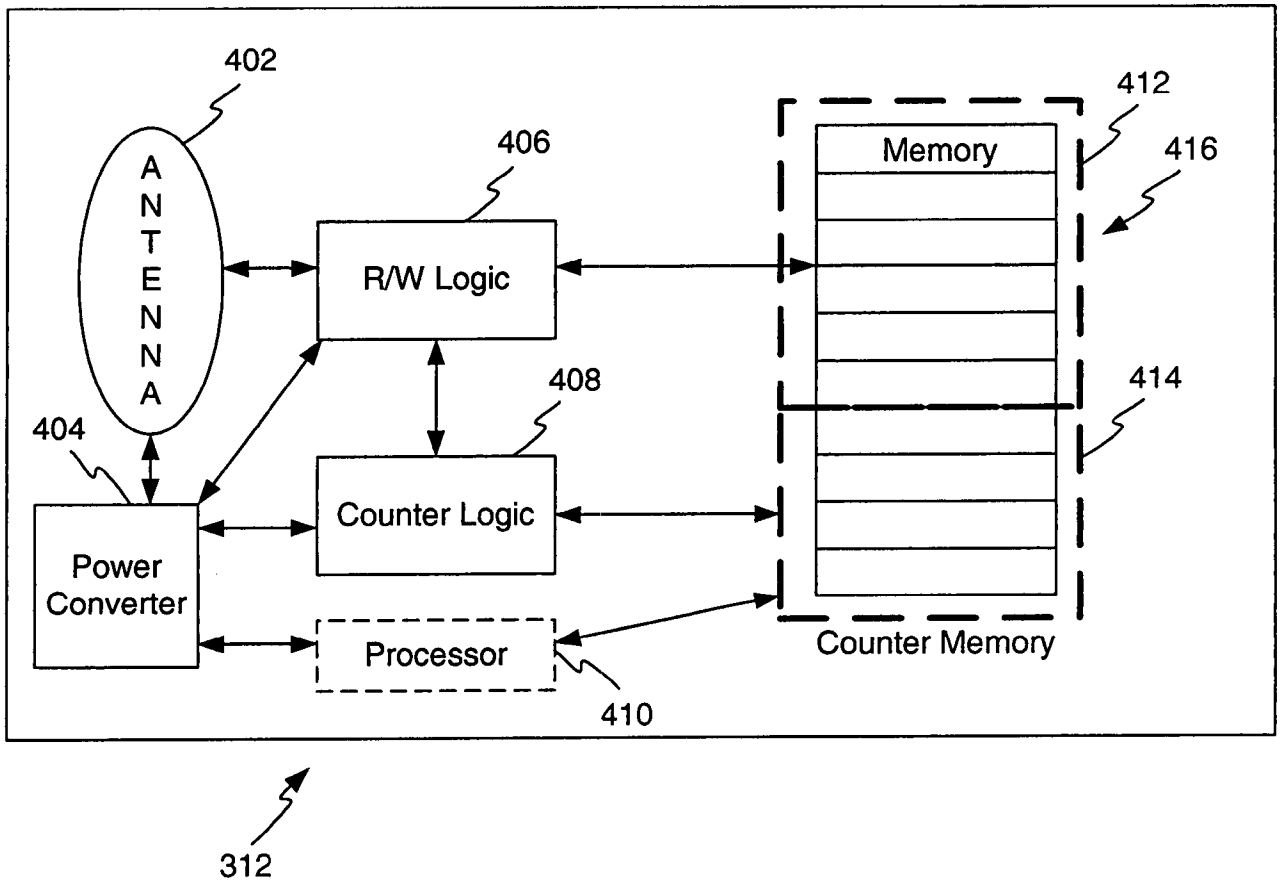
FIG. 4 illustrates a block diagram of an example embodiment of a DID element.

FIG. 4 illustrates a block diagram of an embodiment of the DID element such as found in the token of FIG. 3 described above. For purposes of discussion, it is understood that this is but one possible example configuration of the embodiment and hence the block diagram is not to scale. In this example embodiment the DID element 312 comprises a DID antenna 402 configured to communicate with a reader. As used herein the term reader is defined to mean a reader and antenna element. It is further understood that in the context of this example embodiment, the term "communicate with" may mean "couple to permit data transmission and/or power transfer". As is generally understood, the antenna 402 receives a signal from a reader. This signal may power the element 312 and contain data or commands the initiate operation of the element.

The DID element 312 further comprises one or more power converter 404, R/W (read/write) logic 406, counter logic 408, non-volatile memory 416. The antenna 402 may communicate with the logic 406 and converter 404. In this example embodiment the power converter 404 receives all or a portion of the signal from the antenna 402 and generates power, which powers the other aspects of the element 312. Operation of the logic 406, 408 is described below in more detail.

The DID element 312 may further or alternatively comprise an optional processor 410. Each of the power converter 404, R/W logic 406, counter logic 408, processor 410 and non-volatile memory 416 may comprise one or more circuit elements. The term "non-volatile memory" as used herein refers to memory that may retain data within DID element 312 even when the token is not powered from an external antenna.

Also part of the element 312 is non-volatile memory 416, which may be divided or segmented into data memory 412 and counter memory 414. Locations in data memory 412 and counter memory 414 may be identified by one or more addresses.

Any type data may be stored in memory 412 including but not limited to client or casino name, secret data, encryption information or codes, public information, physical chip size, data regarding memory, creation or in use date, DID type or family, denominational value of the token, locality code to provide for currency differences in different localities, or any other information or data. Some locations of memory 412 may contain writable or re-writable data. One example of rewritable data may include player tracking information. However, other addresses of memory 412 may only be read by a reader.

The counter memory 414 contains counter values stored at one or more locations of counter memory and the locations may be identified by memory addresses. It is contemplated that a counter value may be associated with one or more operations or tasks that may occur within the DID element 312. For example, one counter value may indicate the number of times a particular address (memory locations) has been accessed. For example, if an address is associated with the token's serial number, each time that the token's serial number is accessed, the counter value associated with that address or memory location is incremented. Thus, counter memory is accessed.

Figure 5:
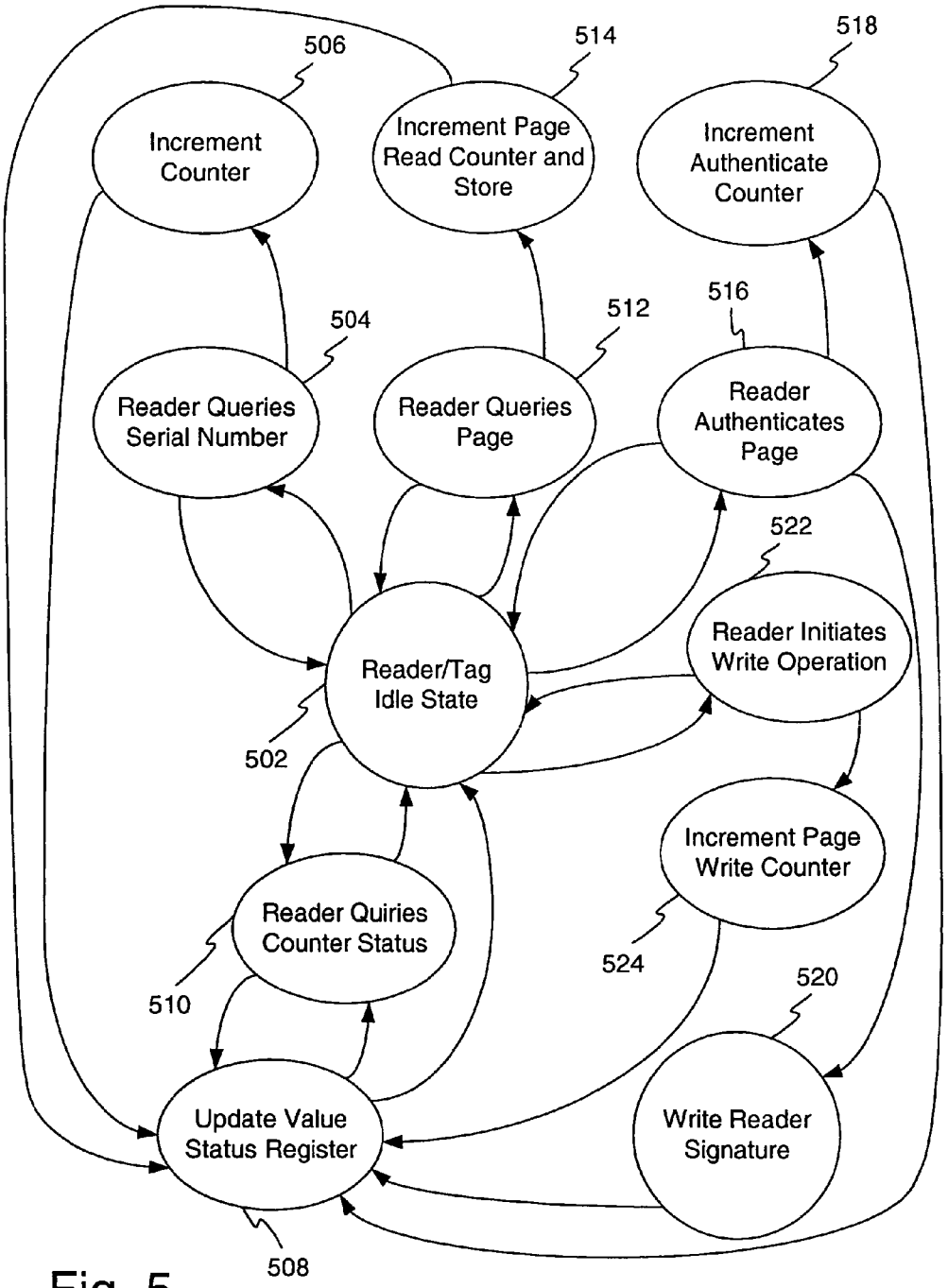
FIG. 5 illustrates an operational flow diagram of an exemplary embodiment of a method for detecting and monitoring a DID element of the type shown in FIG. 4.

In addition, other counter memory locations may store counter values that represent the number of times other actions or operations have occurred within the DID element 312. It is contemplated that any action or operation of the element 312 may be tracked or monitored and upon execution, a counter value incremented and optionally stored in memory. In this manner, a running total of the number of times a particular action or operation has occurred within the element 312. Examples of potential operations which may be tracked and monitored are shown in FIG. 5. Of course, other operations than those shown, may be tracked, and upon occurrence, a counter value incremented.

In one aspect, this disclosure is directed to detecting unauthorized access to information coded within a DID element or unauthorized execution of actions (or attempted execution of actions) within the DID element 312. As is generally understood, a reader (collectively a reader and antenna element) powers the DID element 312 and hence initiates one or more actions of the DID element. There may exist both authorized and non-authorized readers. For example, authorized readers may comprise a reader owned by a casino and which is intended by the casino to read the DID elements. In contrast, unauthorized devices may comprise any device used by one or more persons who have not been authorized by a gaming establishment to communicate with any DID element. Such person may be attempting to commit fraud by reading and/or writing to the DID element 312 in an effort to change or copy important data on the DID element.

According to FIG. 4, R/W logic 406 communicates with memory 416, while counter logic 408 communicates with counter memory 412. Furthermore, R/W logic 406 communicates with counter logic 408. However, it is contemplated that cross-communications may occur between any of R/W logic 406, counter logic 408 and non-volatile memory 416. In other embodiments other patterns of communication may occur without departing from the scope of the claims that follow.

In this embodiment DID element 312 may optionally include a processor 410. The processor 410 may replace the logic elements discussed above, or provide for addition functions within the DID element as typified by central processing units and the like. Furthermore, it is contemplated that R/W logic 406, counter logic 408 and processor 410 may be contained within a single integrated circuit. The processor 410 and logic may comprise or utilize hardware, software, or a combination of both.

In operation, when a reader generates a signal to activate a DID element, communication may occur between the DID element and the reader. Communication may comprise a transfer of power from the reader to the DID element, which in turn provides for communication by driving one or more circuit elements of the DID element 312.

When the DID token antenna 402 receives communication, a portion of the communication may comprise a power signal and a portion may comprise a data signal. The power signal may be communicated to a power converter 404. As a result, the power converter 404 may generate and provide an appropriate power signal to the other circuit elements of the DID element 312, such as one or all of R/W logic 406, counter logic 408, and optional processor 410.

Furthermore, when the DID token antenna 402 receives communication, a portion of the communication may be communicated as data to R/W logic 406. R/W logic 406 may communicate data to memory 412 or the reader may send a signal to the DID element to read data from memory 416. It is contemplated that once powered, the reader and DID element 312 may communicate to read data from and/or write data to the DID element. Other operations may occur including, but not limited to: encrypting or decrypting data, authentication operations, reading data, writing data, and use of external device control ports.

As part of any operation described above, the counter logic 408 may be triggered by R/W logic 406 because the DID element 312 has taken an action, such a read operation. In this embodiment, the counter logic 408 retrieves a counter value from counter memory 414, increments this value and updates counter memory 414 with the incremented value. The retrieved counter value is a counter value associated with the particular action taken by the DID element. There may be a different counter value associated with the various actions that may occur within the DID element 312.

The counter value may be indicative of unauthorized activity between the DID element 312 and other devices of the RFID system, such as a reader. Unauthorized activity may comprise numerous attempted or achieved read or write operations performed by unauthorized readers. In one example of unauthorized access of a DID, an unauthorized reader may attempt to access information so that the DID element may be cloned, copied, or modified. Since the DID comprises a counter logic 408 of the type described above (see also FIG. 5 and the description below), the counter value would be incremented automatically each time the DID element 312 execute a particular action. Unauthorized access of the DID element 312 would increment the counter value.

Determining unauthorized access therefore may lead to a suspicion that unauthorized access of a DID may be occurring. Such knowledge of expected counter values versus unexpected counter values may be obtained from a back end system such as a server (computer system) communicating with authorized readers which keeps a concurrent database of counter values matching the counter values of each DID.

It is contemplated that in one embodiment of the DID, the memory may store authorized reader signatures. During operation, the DID element would compare the reader's signature against the list of authorized readers. Only authorized readers would be able to read the DID. Such readers may be termed "compliant" readers. Additionally, a counter value associated with reader access attempts would be incremented each time the DID was accessed or attempted to be accessed, even if unsuccessful. If there was a discrepancy between the number of times a DID was accessed versus the number of times authorized readers accessed the DID, this discrepancy may further lead to a suspicion that unauthorized access of a DID may be occurring.

Exemplary Methods of Detecting and Monitoring DID

FIG. 5 illustrates an operational flow diagram of method for detecting and monitoring a DID element particular operations or actions within the DID element. With reference to FIG. 5, the term "flow diagram" may be interchangeably denoted "state diagram" and describes interaction steps between one or more readers and DID element from an idle state of the DID element to an active state of the DID element. This is but one possible example embodiment and it is contemplated that other embodiments may be provided which utilize additional or fewer components and modes of operation. In the following description the terms "interrogate" and "query" may be interchangeably used with the term "activate".

In principal, any state in FIG. 5 may be used as a starting point in describing the method for detecting and monitoring a DID element. For the purposes of this discussion, a first state 502 may begin with an initial idle state of a DID element 312 (or tag as labeled in FIG. 5). It is understood that both reader 226 and DID element 312 co-operatively transition between idle and active states, for example when the reader triggers an independent state in the DID element. In order to maintain a state of independence and non reliance to any external logic control device such as a RFID reader, the counter logic should have independent states that should be able to initiate, execute, and complete these states without any knowledge or command structure from any external system.

When a DID passes through a detection zone (see description above), the reader may initiate a variety of command operations. Referring both to FIGS. 4 and 5, in operational state 504 of the method, reader may query the DID element requesting the serial number of the DID token. It is contemplated that DID element may also interrogate the reader or automatically receive reader data and request data pertinent to the reader that may be written to the DID non-volatile memory. The reader data may comprise a reader signature. Such data pertinent to the reader may be stored in memory of the DID element allocated for this purpose (see description below).

In addition to the serial number queries operation executed by the DID element, at state 504, counter logic may retrieve a counter value from counter memory associated with the serial number read operation from the DID. If communication between the reader and the DID is unsuccessful, the reader and/or the DID may return to an idle state as shown by return path from state 504 to state 502.

In state 506, when communication is successful, this serial number counter value may be incremented by counter logic to indicate the DID was queried for the serial number by a reader. Moreover, at state 508, the incremented serial number counter value may then be updated and stored back in the serial number access counter memory address. Thereafter, the DID token may then return to an idle state at state 502. In this manner, when a reader, either authorized or unauthorized, queries the tag to obtain the tag serial number, a counter value that represents how many times that operation has occurred is likewise incremented.

In state 510, when a reader activates the DID token and queries the status register then the "status access" counter will increment to indicate that a reader initiated a command to read the current counter information of the DID. This serves as a means of determining if only authorized reader systems have accessed the status data of the DID by correlating this counter value with system stored counter values. When the DID is queried or powered by a reader, so that the inactive state of the DID becomes an active state, this status counter value may be incremented and stored in counter memory, followed by a return to an idle state of the reader and/or the DID token. This occurs at state 508. It will be appreciated, that any other operation may also be redirected to states 508 and 510 and the status active state counter value may be updated as appropriate.

In state 512 a reader may query other data such as a page of memory. A page may comprise any collection of data such as user information including name of establishment or provider of the DID, password data, denomination value and country code of the DID, and the like. In one example of a page, the page may comprise 4 bytes of information with each byte comprising 8 bits of information. Each DID may have any number of pages depending on the size of the DID memory.

In state 514, when communication is successful, a page counter value may be incremented by counter logic to indicate the DID was queried for the page by a reader. In state 508, the incremented page counter value may then be updated and stored back in a counter value location that represents the number of times the page memory has been read. Either the reader and/or the DID token may then return to an idle state 502.

In state 516 a reader may request DID page authentication. Page authentication refers to a determination of the accuracy of page data. In other embodiments the authentication may comprise of negotiating a public or private key encryption method in order to access the desired page information. In state 518, when communication is successful, a page authentication counter value may be incremented by counter logic to indicate the DID was queried for page authentication by a reader. In state 508, the incremented page authentication counter value may then be updated and stored back in a page authentication counter value memory address. Either the reader and/or the DID may then return to an idle state 502.

In an optional operation, when a reader requests DID page authentication in state 516 (see above), the reader may provide a reader signature as part of the request. The reader signature may comprise data that identifies the particular reader. In state 520, the reader signature may be written to DID memory and a counter value representing that the reader signature written may be updated in DID memory. Either the reader and/or the DID token may then return to an idle state 502.

A benefit of writing a reader signature to DID memory is that unauthorized reader access to private information in a DID may be detected and the ID or signature of the reader may be recorded on the DID. A comparison of a reader's signature against authorized reader signatures stored in DID memory may be a flag that unauthorized access to the DID has occurred. Moreover, the unauthorized reader may be identified and traced thereby allowing an authority to prevent further unauthorized read/write operations. While not all current readers are compliant in providing signature data, the current disclosure suggests great benefit by requiring that all readers be signature compliant.

In an alternative embodiment, a reader may also include counter logic and counter memory and the counter memory may store values related to or identifying the DID when the reader accesses the DID. Such access may indicate that a DID is unauthorized when the DID signature is compared to a data base of authorized DID stored in the reader system. Furthermore, in yet another exemplary embodiment of a counter logic and counter memory located in a reader, the DID may trigger a compliant reader to write a DID's serial number into a reader's data memory anytime the reader queries the DID, or anytime the reader triggers a write cycle within the DID. Advantageously, in this embodiment, the DID may be in control of a process wherein a substantially secure unalterable write cycle is triggered in a compliant reader. As a result, the DID serial number may be written to the reader if an establishment suspected that unauthorized access of a DID was occurring and the establishment could impound the unauthorized compliant reader and determine counter values or DID data stored in the compliant reader to confirm that unauthorized access may have occurred.

As described above, a reader may initiate writing to a DID. This may occur for any purpose, such as during player tracking. In state 522 a reader may initiate a write operation. In state 524, when communication is successful, a write operation counter value may be incremented by counter logic to indicate a reader requested a write operation. Once again, incrementing the counter logic may be used to determine whether an unauthorized reader has accessed the DID because the counter value incremented by the write operation can be compared directly to the corresponding values stored in the reader system for that DID. If these values, i.e. write operation counter values stored in the DID and the write operation value stored in the reader for that DID, do not match, then unauthorized write operations may be occurring. This may be particularly troubling if the value of the DID tag is modified. (see discussion above). In state 508, the incremented write operation counter value may then be updated and stored back in a write operation counter value memory address. Either the reader and/or the DID may then return to an idle state 502. With reference to FIG. 5, it will be appreciated that the status counter value may also be incremented at the same time as the write operation counter value, thereby providing yet another level or feature to determine when unauthorized access of the DID has occurred.

It is contemplated that other operations such as accessing or decrypting DID encrypted information may also trigger a counter value being incremented. Example of encrypted data may include but are not limited to an encrypted code number indicating manufacture date of the DID or an encrypted establishment code number. In yet another embodiment, each time a DID is powered by a reader, another reader may access the DID. A DID may be configured with a counter value to indicate that the DID has been powered-on by a first reader and accessed for data by a second reader. When the counter value for DID power-on by a reader does not correspond to the values for power-on and accessing data from any other reader, an establishment may suspect that an unauthorized reader has attempted to piggy-back onto an authorized reader Furthermore, it may be appreciated that a DID counter logic may be read by a reader, but may be configured to not allow the reader to directly write by a reader. This provides a greater degree of security.

As described above, any back end system such as a server (computer system) communicating with a reader may keep concurrent counter values for each particular DID element within the server's database. The concurrent counter values database, maintained by the reader system, may be used to determine discrepancies indicating unauthorized access to DID counter logic. One method that may be utilized to determine discrepancies is to read the counter values from the DID and then compare these values to the values stored on the reader system. The values stored on the reader system indicate the actual number of times each DID operation occurred or was initiated by an authorized reader. If the counter values stored on the DID do not match the values stored in the reader system, it can be assumed that unauthorized access has occurred.

Another counter feature that may appear on a DID element comprises lifetime usage data indicating the number of times that a DID has been used during its life. Each time the DID is accessed the counter logic may be incremented thereby incrementing a counter value representing usage. This usage counter value may be used to determine usage of a DID. When a DID has reached its useful life limit, the counter logic of the DID element may be programmed to alert a reader to withdraw the DID from further use.

From the earlier discussion regarding counter logic embedded in readers, all elements and steps described herein for DID may also be incorporated in readers.

While various embodiments of the invention have been described, it will be apparent to those of ordinary skill in the art that many more embodiments and implementations are possible that are within the scope of this invention.

What is claimed is:

1. A game token having a counter system comprising:

a housing;

a token identification element at least partially contained within the housing, the token identification element comprising:

at least one antenna configured to receive and transmit a signal;

a memory configured to store a plurality of different types of token data, including: a read attempt value that represents a number of read attempts of the memory, a denomination value and one or more authorized reader signatures; and a counter configured to modify the read attempt value and to maintain the read attempt value within the game token such that the read attempt value represents a number of read attempts of the memory each time the at least one of the plurality of different types of token data is read by an authorized reader; and a processor or control logic configured to:

upon a read attempt of the memory by a reader, compare a signature of the reader against the one or more authorized reader signatures; and generate an alert when the signature does not match any one of the one or more authorized reader signatures.

2. The game token of claim 1, wherein the memory is further configured to store a successful read value representing a number of successful reads of the memory.

3. The game token of claim 1, wherein the counter is configured to retrieve the read attempt value from the memory, increment the read attempt value to create an incremented read attempt value, and write the incremental read attempt value to the memory.

4. The game token of claim 1, wherein the read attempt value represents an actual number of times the token value was read from the memory.

5. The game token of claim 1, wherein the at least one antenna is a radio frequency identification antenna.

6. The game token of claim 1, wherein the housing resembles a coin.

7. A token comprising:

a housing;

an antenna configured to communicate data with a reader external of the housing;

a memory having a read only portion and a writable portion, wherein the memory includes data relating to a listing of authorized reader devices; and a memory logic device configured to read the data stored on the memory and to write data to be stored on the writable portion;

wherein upon a read attempt by a reader, the memory logic device is configured to update a first counter value stored in the memory and to compare an identity of the reader with the listing of authorized readers, wherein if the identity of the reader does not match an entry of the listing of authorized readers, the memory logic device is configured to increment a second counter value stored in the memory relating to a number of unauthorized access attempts.

8. The token of claim 7, further comprising a power converter coupled to the antenna, wherein the power converter is configured to convert a portion of the energy of received radio waves at the antenna into electrical power used to power a component of the token.

9. The token of claim 7, wherein the memory logic device is further configured to transmit the second counter value to an authorized reader upon a read attempt by the authorized reader.

10. The token of claim 7, further comprising data relating to a player tracking information stored in the writable portion of the memory.

11. The token of claim 7, further comprising data relating to a token value stored in the memory.

12. The token of claim 7, wherein the housing resembles a coin.

13. The token of claim 7, further comprising data relating to a write counter stored in the memory.

14. The token of claim 13, wherein the memory logic device is further configured to increment the write counter if the reader initiates a write operation to the memory.

15. A method in a RFID game token comprising an antenna, memory, and a memory logic device, the method comprising:

receiving a first communication from a first reader through the antenna, wherein the communication includes a first reader identifier;

comparing, by the memory logic device, the first reader identifier to a listing of authorized readers stored in the memory;

determining, by the memory logic device, that the first reader is not an authorized reader; and in response to determining that the first reader is not an authorized reader, incrementing a value of a first counter stored in the memory, wherein the first counter relates to a number of unauthorized access attempts.

16. The method of claim 15, wherein the communication includes a request to read data stored in the memory.

17. The method of claim 15, wherein the communication includes a request to decrypt data stored in the memory.

18. The method of claim 15, further comprising:

receiving a second communication from a second reader through the antenna, wherein the communication includes a second reader identifier;

comparing, by the memory logic device, the second reader identifier to the listing of authorized readers stored in the memory;

determining, by the memory logic device, that the second reader is an authorized reader; and in response to determining that the first reader is not an authorized reader, transmitting a value of the counter to the second reader such that the value can be stored in a database of counter values.

19. The method of claim 15, further comprising:

receiving a second communication from a second reader through the antenna, wherein the communication includes a second reader identifier;

comparing, by the memory logic device, the second reader identifier to the listing of authorized readers stored in the memory;

determining, by the memory logic device, that the second reader is an authorized reader; and in response to determining that the second reader is an authorized reader, incrementing a value of a second counter stored in the memory, wherein the second counter relates to a number of authorized access attempts.

20. The method of claim 15, further comprising converting a portion of the communication into electrical power by a power converter.

* * * * *